United States Patent [19]

Mista et al.

[11] 4,414,826

[45] Nov. 15, 1983

[54] SUMMATION DRIVE FOR CONTROLLING SHOGGING IN A WARP KNITTING MACHINE

[75] Inventors: Kresimir Mista, Obertshausen; Norbert Englert, Schaafheim, both of Fed. Rep. of Germany

[73] Assignee: Karl Mayer Textilmaschinfabrik, GmbH, Obertshausen, Fed. Rep. of Germany

[21] Appl. No.: 373,730

[22] Filed: Apr. 30, 1982

[30] Foreign Application Priority Data

May 5, 1981 [DE] Fed. Rep. of Germany ..... 3117683

[51] Int. Cl.[3] ..... D04B 23/00

[52] U.S. Cl. ..... 66/207

[58] Field of Search ..... 66/207, 203, 204

[56] References Cited

U.S. PATENT DOCUMENTS

| | | | |
|---|---|---|---|
| 3,089,322 | 3/1963 | Bruce et al. | 66/207 |
| 3,478,543 | 11/1969 | Faninger | 66/205 |
| 3,653,232 | 4/1972 | Walter | 66/205 |
| 3,729,954 | 5/1973 | Ducol | 66/205 |
| 4,335,590 | 6/1982 | Bergmann et al. | 66/207 |

FOREIGN PATENT DOCUMENTS

| | | | |
|---|---|---|---|
| 270494 | 2/1914 | Fed. Rep. of Germany | 66/207 |
| 458199 | 3/1925 | Fed. Rep. of Germany | 66/207 |

*Primary Examiner*—Ronald Feldbaum

*Attorney, Agent, or Firm*—Behr & Adams

[57] ABSTRACT

A summing arrangement controls the shogging movement of a guide bar of a warp knitting machine. The arrangement has a plurality of ordered elements each having at least one curved face. The ordered elements are mounted on the machine to allow a variation in the spacing between each. Also included is a plurality of adjustable roller devices, one between each adjacent pair of elements. Each of these roller devices can roll upon and push at least one of the elements at its curved face.

11 Claims, 4 Drawing Figures

SUMMATION DRIVE FOR CONTROLLING SHOGGING IN A WARP KNITTING MACHINE

BACKGROUND OF THE INVENTION

1. Field of the Invention

The present invention relates to a guidebar shogging guide apparatus for warp knitting machines and in particular to a guide apparatus that is adjustable and automatically programmable in fixed increments that are proportional to the knitting machine needle spacing.

2. Discussion of the Relevant Art

Shogging mechanisms of different types are available in the art and are disclosed in a textbook entitled, "Warp Knitting Technology" by D. F. Paling first published in 1952 and reprinted in 1970 by the Columbine (Publishers Limited). Another shogging or steering element is disclosed in "Die Kettenwirk Maschine" by Emil Michael, published by Konradinverlag Robert Kohlhammer of Stuttgart, West Germany; pages 37 through 40 disclose a guide mechanism to control the movement of a warp knitting machine guidebar which contains seven setting elements (see FIG. 55 at page 39) to obtain the incremental distances that the guidebar is to be moved. The movable setting elements are placed into position by means of a conventional jacquard arrangement. The jacquard arrangement moves the setting element into a predetermined position so that the head portion of the setting element provides a defined thickness along a longitudinal axis. By choosing a combination of different setting elements, having different thicknesses, the longitudinal thickness which determines the position of the silder bar that is operably coupled to the guidebar, may be modified in accordance with the preset program.

In a known arrangement of this type (DE-PS 482,949) the summation drive comprises a plurality of cam plate pairs which are axially mounted upon a rod and this rod is rotatably supported. By a relative rotation of 180° between both plates of a pair there is provided a displacement of 1, 2, 4 8 or 16 needle spaces so that at the free end of the summation drive there may be provided a displacement of up to 31 needle spaces. Under the influence of a tension spring the guidebar is forced into contact with the free end of the summation drive. The tension spring causes the cam plates to contact one another in a force transferring manner.

In such summation drives, however, there is a considerable amount of friction when the plates, under the influence of the spring tension, are moved relative to each other. This leads to an undesirable generation of heat as well as wear. The structural options for the curved surfaces are limited. This leads to disturbing noises during resetting.

A novel arrangement is known for eliminating the problem of friction. This is disclosed in DE-OS 2926929 (allowed U.S. patent application 165,020 filed July 1, 1980, and U.S. Pat. No. 4,312,196). This arrangement for the displacement of the guide bar comprises two alternately activated sliders which operate in conjunction with a series of jacquard influenced setting elements provided perpendicular to the shogging direction. These setting elements have different thicknesses and can be set to provide a desired amount of displacement. This arrangement requires a pair of summation drives.

SUMMARY OF THE INVENTION

A summing arrangement according to the principles of the present invention can control the shogging movement of a guide bar of a warp knitting machine. This arrangement has a plurality of ordered elements, each having at least one curved face. Each of the elements is mounted in the machine to allow a variation in the spacing between each. Also included is a plurality of adjustable rolling means. A corresponding one of the rolling means is engaged between each adjacent pair of the elements and can roll upon and push at least one of the elements at its curved face.

Accordingly it is one object of this invention to provide an arrangement of the type hereinbefore described which comprises only a single friction free summation drive.

By employing equipment of the foregoing type, a simple, efficient and reliable apparatus is provided for controlling shogging without unnecessary friction and wear. In a preferred embodiment the shogging adjustment is performed through an impulse roller which is displacable across the curved surface of an element. This roller can be supported on a neighboring element by means of an intermediate member, in some embodiments. In other embodiments duplex rollers engage two adjacent elements.

In either mode of construction the amount of friction is minimal since the roller rolls upon the appropriate curved displacement surface. The amount of wear and frictional heating are similarly minimized. The exact positioning of the guides of a guide bar with respect to the associated needles of the needle bar is therefore not impaired either by reason of wear or by reason of thermal expansion. If the impulse rollers are supported on the neighboring element by means of an intermediate element, or if duplex rollers separate adjacent elements, the desired summation effect is achieved. The displacement curve surfaces can be designed for relatively quiet operation.

BRIEF DESCRIPTION OF THE DRAWINGS

In order that the invention may be more fully understood, it will now be described, by way of example, with reference to the accompanying drawings in which.

DESCRIPTION OF THE PREFERRED EMBODIMENTS

Figure 1:
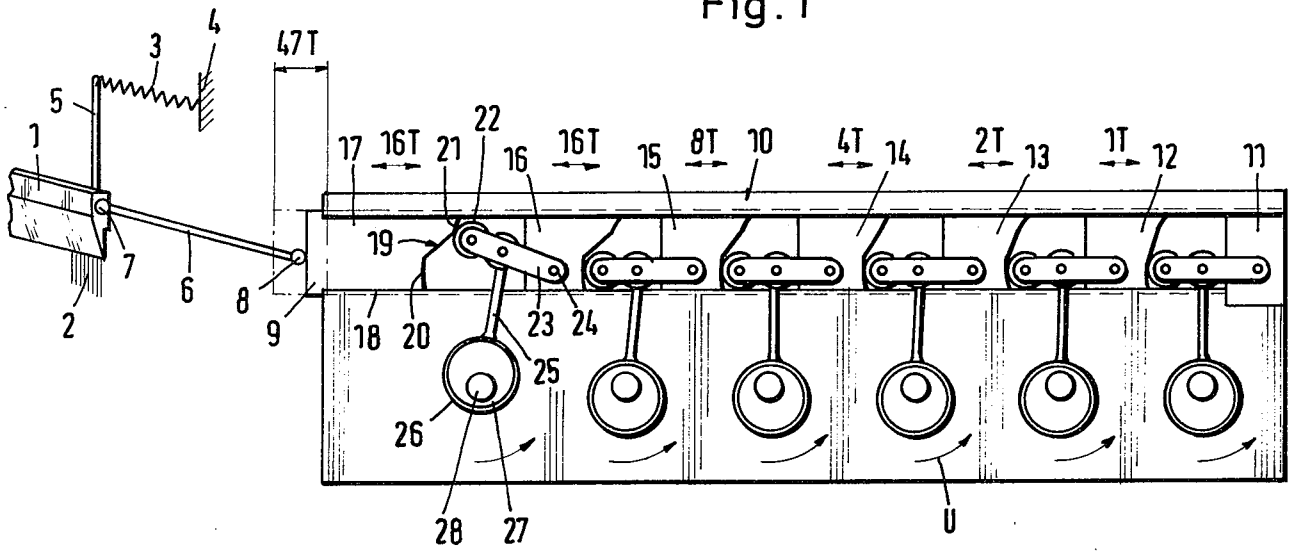
FIG. 1 is a side, elevational, cross sectional view of the first embodiment of the invention.

FIG. 1 illustrates a longitudinally reciprocatable guide bar 1 having a spaced plurality of conventional guides 2. Spring 3 is held at one end thereof by a fixed support 4 its other end connecting to and acting upon guide bar 1 via connecting means 5. Rod 6 is held in contact with guide bar 1 via roller bearing 7 on one end of rod 6. The other end of rod 6 is connected via roller bearing 8 to the free end 9 of summing arrangement 10.

Summation drive 10 comprises fixed element 11 and six movable, ordered elements 12 through 17 in the shape of blocks, the latter six being longitudinally slidable in fixed guideway 18. Element 17 comprises a curved displacement surface 19 both of whose contiguous end segments 20 and 21 are responsible for the displacement of element 17. Guideway 18 has a lower and upper channel for receiving the elements 12–17 and may incorporate ball or other bearings to facilitate motion in the guideway.

A rolling means is shown herein as a roller and intermediate means. The intermediate means is shown as bracket 23 pivoted at axle 24 to element 16. The impulse roller 22 lies in contacting relationship with surface 19 and is rotatably supported in pivoting lever 23 which serves as an intermediate member. Preferably, elements 12–17 are non-rotatably held in guideways 18 and impulse rollers 22 are displacable substantially perpendicularly to the longitudinal direction of the guideway. This results in a much simpler control mechanism than that achieved by using rotatable elements. Pivoting lever 23 is rotatable about axis 24 set in adjacent elenent 16 so that roller 22 can move between surfaces 20 and 21, changing the spacing between elements 16 and 17. Pivoting lever 23 is pivotally connected to eccentric rod 25 at one end thereof and its other end being rigidly connected to ring 26 which encompasses eccentric cam 27. Said cam 27 is rigidly fixed to shaft 28 which is rotatable through 180° by an unillustrated control arrangement suitably in the same direction, that is to say, in the direction of arrow U. Similar impulse rollers, intermediate means and cams are provided to the corresponding remaining elements 12 through 16. The net effect is that the individual displacements between adjacent pair of elements 12–17 is summed by pivoting selected ones of the levers 23 supported by the neighboring element on which the impulse roller is rotatably supported. The desired displacement is achieved thereby through a simple pivoting motion.

The curved displacement surfaces 19 of individual elements 12–17 are graded differently so that by displacement of different ones of the pivoting levers 23 from the horizontal position into the upper contact position, individual pairs of elements can be separated by different amounts. Thus the amount of separation. between elements 17 and 11 can be coarsely and finely controlled. The displacement achievable between elements 11 and 12 comprise 1T where T is equivalent to the needle to needle space on the needle bar. The displacement achievable between elements 12 and 13 is equivalent to 2T, between elements 13 and 14 is 4T, between elements 14 and 15 is 8T, between elements 15 and 16 is 16T, and between elements 16 and 17 is similarly 16T. Thus, it is possible to displace guide bar 1 by every integer multiple of T from between 1T through 47T. In all of these actions the individual elements 12–17 are compressed into a force transferring relationship by the action of spring 3. Because of the use of impulse rollers, the net displacement movement may be carried out without substantial friction or heating effect despite the existence of the spring force. The arrangement may also be utilized during substantially high machine speeds. The noise effect during operation is minimal.

Figure 2:
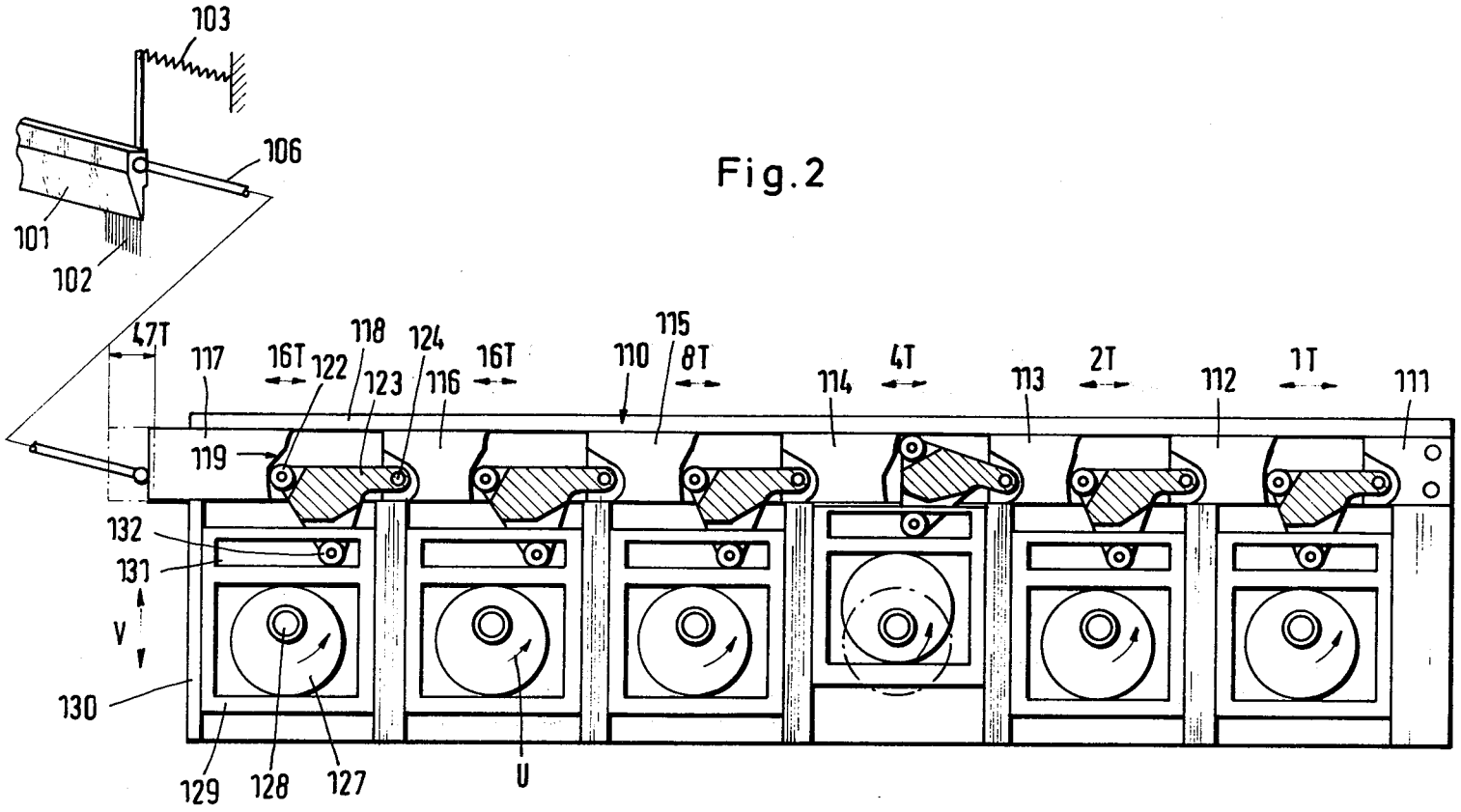
FIG. 2 is a side, elevational, cross sectional view of the second embodiment of the same invention.

In the arrangement illustrated in FIG. 2, corresponding parts are designated by unit numbers increased by 100. A similarity between these embodiments is the inclusion of circular eccentric cam 127 affixed to rotatable shaft 128. Rotation of shaft 128 through an angle of 180° is controlled by a Jacquard or similar arrangement (not shown), for example, apparatus in accordance with the system disclosed in DE-PS 482,949. Eccentric cam 127 operates through a sliding crank block 129 which is slidable in vertical chambers in guideway 130, in the direction of arrow V. In this embodiment block 129 is a rectangular frame embracing in its lower chamber cam 127, which by rotating, vertically reciprocates block 129. This block comprises longitudinal slit 131 in which guide roller 132 attached to pivot lever 123 may run. Lever 123 has a generally triangular shape, one apex containing pivot 124. Roller 122 is supported on another apex, the remaining apex supporting roller 132. Also, lever 123 has a forked apex at axis 124 to straddle the components thereat. Pivot 124 of lever 123 is pivotally connected at a recess of element 116 to limit the total thickness.

It is apparent that there exists between elements 116–111 apparatus similar to that between elements 116 and 117. The rollers 122 can be rolled upwardly over surfaces 119 of elements 117, 116, 115, 114, 113 and 112 to increase the net displacement of bar 101 by 16T, 16T, 8T, 4T, 2T and 1T, respectively, T being one needle space as previously defined. Thus the mode of operation in this embodiment is similar to that shown in FIG. 1.

Figure 3:
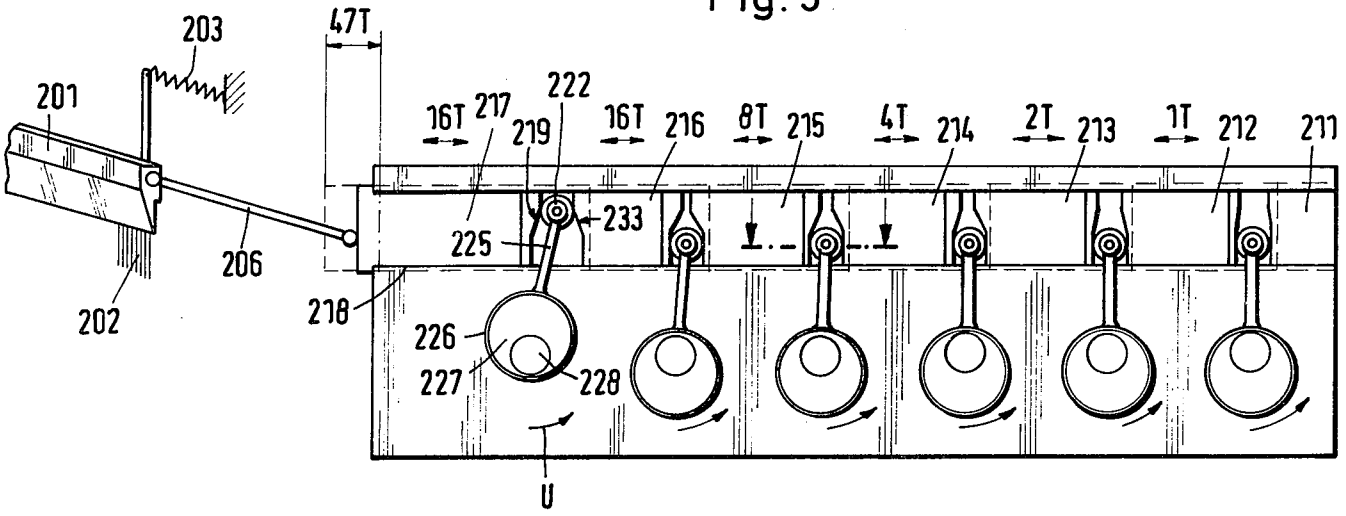
FIG. 3 is a side, elevational, cross sectional view of the third embodiment of the same invention.
Figure 4:
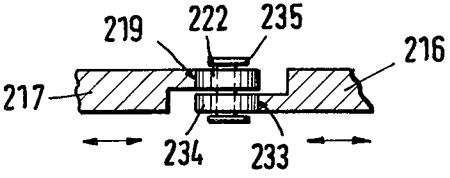
FIG. 4 is a cross sectional view taken along the lines III—III of FIG. 3.

In the embodiment of FIGS. 3 and 4 corresponding elements carrying a numbering 200 units greater than that of FIG. 1. The opposing faces of elements 216 and 217 have opposing curved surfaces 233 and 219, respectively. Curved surfaces 233 and 219 are shaped as staggered, flange-like tracks extending from the main bodies of elements 216 and 217. While surfaces 233 and 219 face in opposite directions they are transversely misaligned to permit engagement by coaxial rollers 234 and 222, respectively, without interference. In this embodiment impulse roller 222 which rolls on the curved displacement surface 219 is supported and thrust into position by adjacent element 216. Element 216 bears on second impulse roller 234 which rolls on running surface 233. This running surface 233 similarly serves as a displacement curve and is oriented conversely to that of displacement surface 219. The impulse roller 234 is mounted on the same axis 235 as impulse roller 222 but is rotatable independently thereof. The axle of axis 235 is supported on the forked upper end of connecting rod 225 whose lower end is the same as and has the same cooperating apparatus as that shown in FIG. 1. When cam 227 is rotated 180° to produce a peak upward stroke, the two impulse rollers 222 and 234 move upwardly whereby element 217 is moved to the left by 16T units (as defined earlier). The same is true for the other adjustment devices as they affect elements 212–216. The drive of the eccentric shaft 228 can be controlled in the usual manner, for example, with coupling means which operate in dependence upon a Jacquard arrangement.

It will be understood that the five other illustrated eccentric cams are Jacquard-controlled and each control the spacing between an associated pair of elements 211–216. In particular, elements 212, 213, 214, 215, 216 and 217 can each add an additional amount of displacement, to the extent of 1T, 2T, 4T, 8T, 16T and 16T, respectively. It is significant that the intermediate element is second impulse roller 234 which is rotatable about the same axis independently from first impulse roller 222 and which contacts contact surface 233 on the interface of the neighboring element 216. Since second impulse roller 234 is rotatable independently of first impulse roller 222 both may also roll on the appropriate contact surface in a substantially friction free manner. Furthermore, since the contact surfaces 219 and 233 are also a curved displacement surface, the displacement caused by the activation of the adjusting arrangement is then determined by both curved surfaces. This gives rise to smaller angles on the contact surface 219 and 233 and gives rise to a quieter run.

In a typical operation, after each stitch, guidebar 1 of FIG. 1 ought to be moved longitudinally (shogged) a desired amount (which amount may include zero) to perform an underlap. It will be assumed that all of the levers 23 are in the downmost position at this time, although this is not necessarily so and will vary depending upon the desired pattern. Furthermore since cams 27 are Jacquard-controlled, they need not return at the end of each cycle to a specific state but can vary independently and non-periodically. Furthermore there are 64 possible combinations for the positions of levers 23, corresponding to possible displacements of guide bar 1 from 0T to 47T (each of the displacements 16T through 31T can be achieved in two ways). Also all of the foregoing combinations may or may not be used, depending upon the desired pattern.

Accordingly, the first shogging motion is accomplished by rotating Jacquard controlled shaft 28 by 180° to orient cam 27 as shown in FIG. 1. The consequent lifting of roller 22 across surface 21 drives element 17 outwardly to accomplish an underlap. Thereafter guidebar 1 can swing through the needles (not shown) and shog in either direction to accomplish an overlap. This may be accomplished by resetting cams 27 to any one of the above noted combinations. Thereafter guidebar 1 may again swing after which another knitting cycle can be performed. The foregoing described the operation of the embodiment of FIG. 1 but it is apparent that operation of the cams of FIGS. 2 and 3 will produce the same result with different mechanical linkages and apparatus.

It is advantageous in these adjusting arrangements to utilize an eccentric cam for the displacement of the impulse roller. Such a cam can, for example, operate via a push rod acting on the lever to displace the axis of the impulse roller. However, various alternate devices including various bell cranks, solenoids, pneumatic actuators and other actuators may be used instead. The levers may also be provided in the form of a rocker arm in various shapes and having one or more rollers in addition to the impulse roller. An additional roller can be slidably mounted or linked to a guideway of a sliding block crank or other device whose motion, perpendicular to the shogging direction, is similarly controlled by an eccentric cam or another Jacquard-controlled device.

It will be understood that various changes in the details, materials, arrangement of parts and operating conditions which have been herein described and illustrated in order to explain the nature of the invention may be made by those skilled in the art within the principles and scope of instant invention.

Having thus set forth the nature of the invention, what is claimed is:

1. A summing arrangement for controlling the shogging movement of a guide bar of a warp knitting machine, comprising:

a plurality of ordered elements each having at least one curved face and each being mounted in said arrangement to allow a variation in the spacing between each; said ordered elements comprising one terminal fixed element, the remaining elements being movable in a longitudinally reciprocatable manner, the most distant face of the movable element most distance from said fixed element being operatively couplable to said guide bar for moving said guide bar in a longitudinally reciprocatable manner and a plurality of adjustable rolling means, a different corresponding one being engaged between each adjacent pair of said elements for rolling upon and pushing at least one of said elements at its curved face.

2. A summing arrangement according to claim 1 wherein each of said rolling means comprises:

a roller disposed against the curved face of a corresponding one of said elements; and an intermediate means connected between said roller and an opposing one of said elements.

3. A summing arrangement according to claim 2 further comprising:

a guideway mounted in said machine, each of said elements being mounted in and moveable through said guideway without rotating, the roller between adjacent ones of said elements being operable to move transversely to the length of said guideway.

4. A summing arrangement according to claim 3 wherein said intermediate means is pivotally connected to said opposing one of said elements.

5. A summing arrangement according to claim 1 wherein each of said rolling means comprises:

a pair of coaxial rollers for separately rolling on opposing surfaces of an adjacent pair of said elements, one of said surfaces of the pair being said curved surface.

6. A summing arrangement according to claim 5 wherein each element has on each of its sides that face an adjacent one of said elements said curved face.

7. A summing arrangement according to claim 4 further comprising:

adjusting means for varying the position of said intermediate means in each of said rolling means.

8. A summing arrangement according to claim 7 wherein said adjusting means comprises:

a plurality of eccentric cams rotatably mounted in said machine, each one of said cams separately coupled to the intermediate means of a corresponding one of the rolling means.

9. A summing arrangement according to claim 8 wherein each of the rolling means comprises:

a push-rod connected between said intermediate means and the associated one of said eccentric cams.

10. A summing arrangement according to claim 8 wherein said adjusting means comprises:

a plurality of crank blocks slidably mounted in said machine, each embracing a corresponding one of said eccentric cams and being reciprocatingly drivable thereby in direction transverse to the length of said guideway.

11. A summing arrangement according to claim 10 wherein each of said blocks has a slit running in about the same direction as the length of said guideway, the intermediate means of each of said rolling means having a guide wheel mounted thereon to roll within the slit of a corresponding one of said crank blocks.

* * * * *